US005174494A

United States Patent [19]

Ashby

[11] Patent Number: 5,174,494

[45] Date of Patent: Dec. 29, 1992

[54] BIFOLD MAILER WITH RETURN ENVELOPE

[75] Inventor: Robert E. Ashby, Quakertown, Pa.

[73] Assignee: Moore Business Forms, Inc., Grand Island, N.Y.

[21] Appl. No.: 770,862

[22] Filed: Oct. 4, 1991

[51] Int. Cl.[5] ..... B65D 27/06

[52] U.S. Cl. ..... 229/305; 229/69; 229/301; 229/314

[58] Field of Search ..... 229/69, 300, 301, 305, 229/314, 316

[56] References Cited

U.S. PATENT DOCUMENTS

| | | | |
|---|---|---|---|
| 2,158,528 | 5/1939 | Sawdon | 229/305 X |
| 2,517,843 | 8/1950 | Cochran | 229/305 X |
| 3,525,469 | 8/1970 | Sawdon | 229/305 |
| 3,833,167 | 9/1974 | Kapitan | 229/69 |
| 4,023,727 | 5/1977 | Tess | 229/69 |
| 4,148,430 | 4/1979 | Drake | 229/69 |
| 4,199,630 | 4/1980 | Consiglio | 428/43 |
| 4,239,114 | 12/1980 | Denay | 206/610 |
| 4,756,468 | 7/1988 | Jenkins | 229/73 |
| 4,859,083 | 8/1989 | Nocek et al. | 383/37 |
| 4,860,946 | 8/1989 | Braud | 229/69 |
| 4,927,072 | 5/1990 | Jenkins et al. | 229/69 X |
| 4,981,251 | 1/1991 | Jenkins et al. | 229/92.3 |

*Primary Examiner*—Allan N. Shoap
*Assistant Examiner*—Jes F. Pascua
*Attorney, Agent, or Firm*—Nixon & Vanderhye

[57] ABSTRACT

A mailer type business form, an intermediate for the form, and a method of making the form are provided. The mailer type business form is constructed from a single ply sheet of paper and a small panel (less than one-quarter the size of the sheet) which cooperates with a quadrant of the sheet to provide a return envelope. The sheet is folded along orthogonal fold lines to provide four plies, a fifth ply being provided by the panel which cooperates with one of the plies to form the return envelope. The mailer is constructed by positively guiding the panel (preferably utilizing a tractor hole strip along one edge) into contact with predetermined adhesive strips on the single ply sheet, and then subsequently folding the sheet along the orthogonal fold lines.

17 Claims, 3 Drawing Sheets

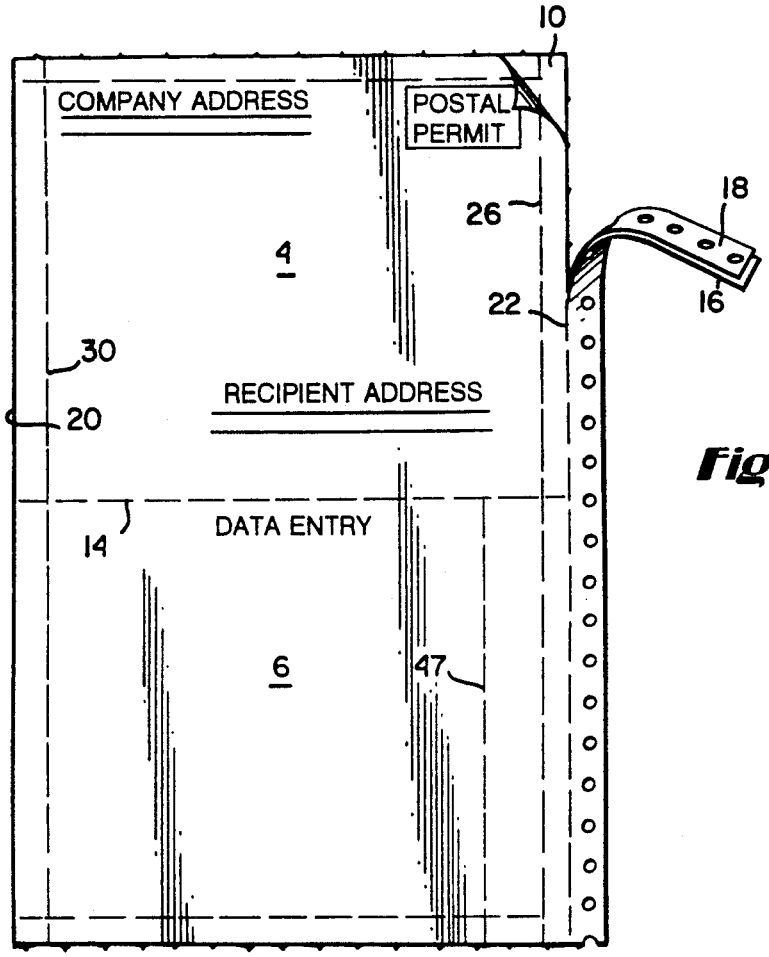
Fig. 5
Fig. 8
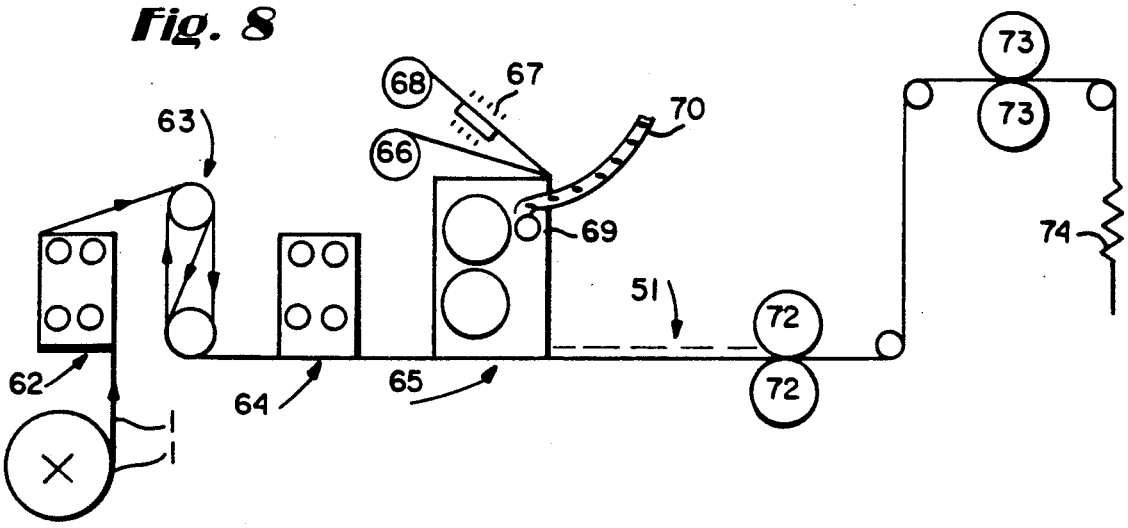

BIFOLD MAILER WITH RETURN ENVELOPE

BACKGROUND AND SUMMARY OF THE INVENTION

Mailers are widely used types of business forms. It is desirable to be able to manufacture mailers as simply as possible, yet provide a high degree of versatility and functionality thereof. One particularly desirable form of mailer, which has four plies (and can have inserts provided therein too) is constructed from a single sheet of paper having particular strips thereon, is shown in FIGS. 8 through 12 of U.S. Pat. No. 4,981,251. The mailer illustrated therein is very desirable, however it has a drawback in that a return envelope is not provided therewith. It is desirable to provide a return envelope with a mailer to facilitate the return of a portion of the mailer to the addressor of the mailer.

According to the present invention, a mailer type business form is provided which has the advantages of simplicity of manufacture, and functionality of the end product, of the mailer of FIGS. 8 through 12 of U.S. Pat. No. 4,981,251, and also has a return envelope associated therewith. The return envelope is formed utilizing a small panel in a quadrant of the sheet itself, and is constructed in a simple manner that does not interfere with, or have any significant affect on, the speed or manner of production The invention also comprises an intermediate for a mailer, and a method of manufacture of the mailer.

According to one aspect of the present invention, an intermediate of a mailer type business form is provided which comprises the following elements: A quadrate ply having first and second faces. First and second orthogonal fold lines separating the ply into first, second, third and fourth quadrants, the first and third quadrants diagonally dispose with respect to each other, the first and second quadrants separated by the second fold line, and the first and fourth quadrants separated by the first fold lines, and each of the quadrants of the quadrants having two free edges. The first face of the first quadrant having outgoing addressee information thereon, and the first face of the fourth quadrant having adhesive strips adjacent the first fold line and two free edges thereof, but not adjacent the second fold line. The second face of the first and second quadrants having adhesive strips adjacent the two free edges thereof, but not adjacent the fold lines. A first perforation parallel to the first fold line and on the opposite side of the fourth quadrant adhesive strip adjacent a free edge from that free edge, and extending through the fourth and third quadrants. A second perforation parallel to &.he first perforation and extending through the first and second quadrants spaced from the free edges thereof the same distance the first perforation is spaced from the free edges of the third and fourth quadrants. Third and fourth perforations parallel to the first perforation, and spaced an equal distance from, and adjacent, the first fold line, the third perforation extending through the third and fourth quadrants, and the fourth perforation through the first and second quadrants. Fifth and sixth perforations parallel to the second fold line, and adjacent but spaced from the free edges of quadrants parallel to the second fold line, the fifth perforation extending through the first and fourth quadrants, and the sixth perforation though the second and third quadrants. A first panel, for cooperating with the second quadrant second face for forming a return envelope, having dimensions less than the dimensions of the second quadrant between the second fold line and second, fourth, and sixth perforations. And, adhesive means for attaching the first panel and the second quadrant together to form a return envelope.

Address information is provided on the first panel, as is an adhesive strip. A fold line is also provided on the first panel adjacent the adhesive strip, which is preferably transfer tape. The fold line overlies a seventh perforation in the quadrate ply, extending in the second panel parallel to the first fold line. The adhesive means is preferably adjacent the second fold line on the fourth and sixth perforations, but not the second perforation.

According to another aspect of the present invention, a mailer type business form is provided. The mailer comprises the following elements. First, second, third, fourth, and fifth plies. Adhesive connecting the first ply to the fourth ply along two edges thereof. Adhesive connecting the fourth ply to the third ply along three edges thereof. Adhesive connecting the second ply to the third ply along two edges thereof. Adhesive connecting the second ply to the fifth ply to form a return envelope, the return envelope disposed between the third and second plies. Perforations along the side edges of the ply, inside the adhesive, to provide removable edge strips of the plies so that the plies may be separated from each other by detachment of the edge strips. And, one of &:he panels formed by separation of the plies comprising a return envelope.

The invention also relates to a method of forming a multi-ply mailer type business form with return envelope from a single ply sheet having first and second faces, and a panel. The method comprises the following steps: (a) Applying adhesive strips to the first and second faces of the single ply sheet. (b) Positively guiding the panel into contact with a predetermined adhesive strip on the second face of the single ply sheet, the panel and a portion of the single ply sheet cooperating with it forming a return envelope. (c) Forming perforations, and first and second orthogonal fold lines, in the single ply sheet. And, (d) folding the single ply sheet about the fold lines into quadrants so that the single ply sheet forms two outer plies and two inner plies, with the panel between plies. The panel has tractor holes along one edge, and step (b) is practiced by feeding the panel with a drive mechanism which engages the tractor holes. There is also the step (e) of cutting off a strip containing the tractor holes. There is also preferably the step of applying transfer tape to the panel. Steps (a) through (d) are preferably practiced consecutively and continuously, the sheet being part of a continuous web, and then there is the further step of separating each sheet from adjacent sheets in the production of the mailer.

It is the primary object of the invention to provide for the ultimate construction of a mailer, with return envelope, from a single ply sheet and panel in a simple yet effective manner. This and other objects of the invention will become clear from an inspection of the detailed description of the invention, and from the appended claims.

BRIEF DESCRIPTION OF THE DRAWINGS

FIG. 5 is a view of the mailer of FIG. 4 with the right hand portion folded backwards and illustrating the front side of the right hand portion;

FIG. 8 is a schematic view illustrating the method of production of a mailer according to the invention.

DETAILED DESCRIPTION OF THE DRAWINGS

Figure 1:
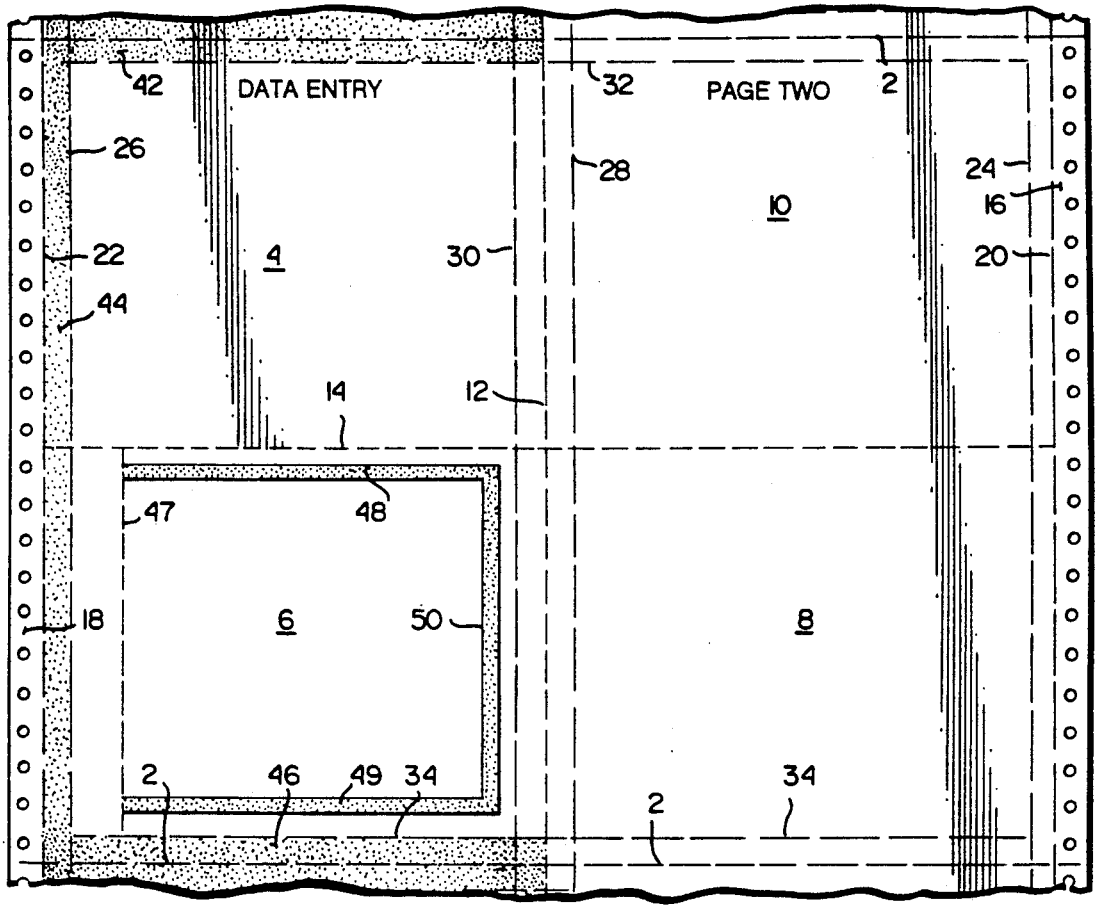
FIG. 1 is a top plan of a second face of an intermediate of a mailer type business form according to the invention, with the return envelope forming panel being removed for clarity of illustration.
Figure 4:
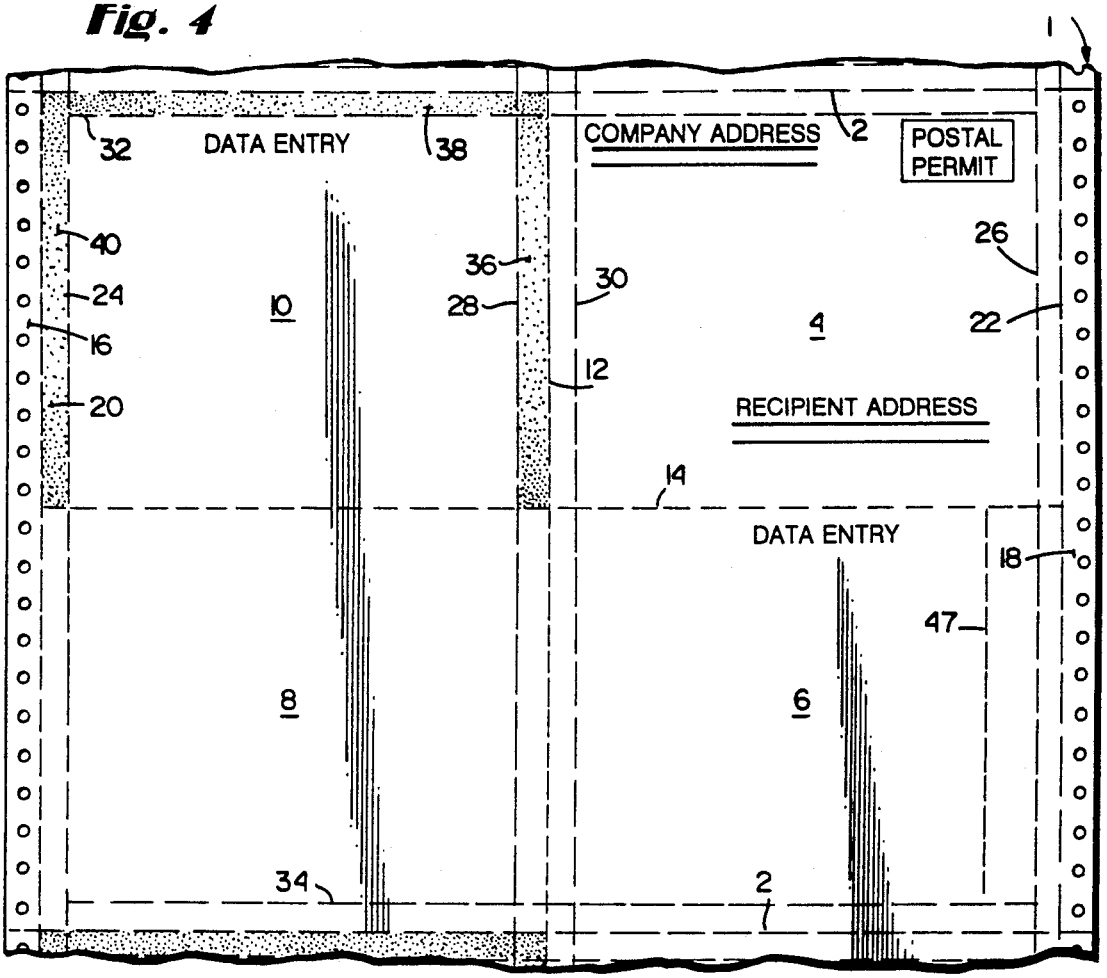
FIG. 4 is a view like that of FIG. 1 only showing the first face of the intermediate.

FIGS. 1 and 4 show a single ply paper sheet (form) which comprises one of a plurality of forms in a continuous web, the additional forms being illustrated adjacent opposite ends of form 1 and connected thereto by the lines of perforation 2. Sheet 1 is divided into first, second, third and fourth panels, preferably quadrants, 4, 6, 8 and 10, respectively, by first and second orthogonally related fold lines 12 and 14, respectively. Particularly, the fold line 12 extends vertically substantially medially of form I as illustrated in FIG. 4 while the fold line 14 extends horizontally substantially medially between and parallel to the lines of perforation 2 in FIG. 4. Consequently, the first and second panels 4 and 6 lie on opposite sides of the fold line 12 from the third and fourth panels 8 and 10. Also, the fourth and first panels 10 and 4 lie on opposite sides of the fold line 14 from the second and third panels 6 and 8, respectively.

As illustrated in FIGS. 1 and 4, the first panel 4 on a first face of the sheet 1 may be provided with address information, for example, the address of the recipient, and the return address of the entity mailing the mailer. The remaining panels may be employed for data entry, although it will be appreciated that panel 6 in FIG. 1 will be exposed to view in the final form of the mailer, whereas data entered on panels 8 and 10, as illustrated in FIG. 4, would be hidden from view in the final form of the mailer. The panels of the opposite side of the sheet illustrated in FIG. 1 (see FIG. 4) may also be used for data entry purposes.

Referring now to FIG. 4, marginal feed strips 16 and 18 are provided along opposite edges of form 1 and have tractor openings whereby the form may be used in printers. The marginal feed strips 16 and 18 are connected to the form 1 along marginal lines of perforation 20 and 22, respectively. Additionally, first and second lines of perforations 24 and 26, respectively, are inset from lines of perforations 20 and 22, respectively. Vertically extending third and fourth lines of perforations 28 and 30, respectively, are also provided adjacent the fold line 12. Horizontal, fifth and sixth, lines of perforations 32 and 34, respectively, are also provided inset from the separation lines of perforations 2. A heat-activated, permanent-type adhesive is disposed along three sides of the margins of the form in the fourth panel 10. Particularly, a line of adhesive 36 is provided between fold line 12 and perforation line 28. A line of adhesive 38 is provided between the separation line of perforations 2 and perforation line 32. Finally, a line of adhesive 40 is provided between marginal line of perforations 20 and perforation line 24. It will be appreciated that panel 4 may be provided with adhesive in the same orientation as the lines of adhesive are applied to panel 10 in lieu of such adhesive in panel 10, as will become apparent from the ensuing description.

Turning now to FIG. 1, on the reverse sides of panels 4, 6, lines of adhesive are provided along the outer edges thereof. Particularly, a line of adhesive 42 is provided between the separation line of perforations 2 and perforation line 32 in panel 4. A line of adhesive 44 is provided along the free edges of both panels 4 and 6 between the perforation lines 22 and 26. A final line of adhesive 46 is provided in panel 6 between the perforation lines 2 and 34.

To fold the sheet 1—which comprises an intermediate for a mailer type business form—into a mailer, the righthand portion illustrated in FIG. 4, including panels 4 and 6, are folded backwardly about the fold line 12 such that the lines of adhesive thereof on the opposite side, i.e., adhesive lines 42, 44 and 46, register with corresponding marginal strips along the edges of panels 10 and 8. The result of the first fold about fold line 12 is illustrated in FIG. 5, wherein panels 8 and 10 lie behind panels 6 and 4, respectively. By such folding it will be appreciated that the lines of perforations register one with the other, enabling the tear strips to be removed.

Figure 6:
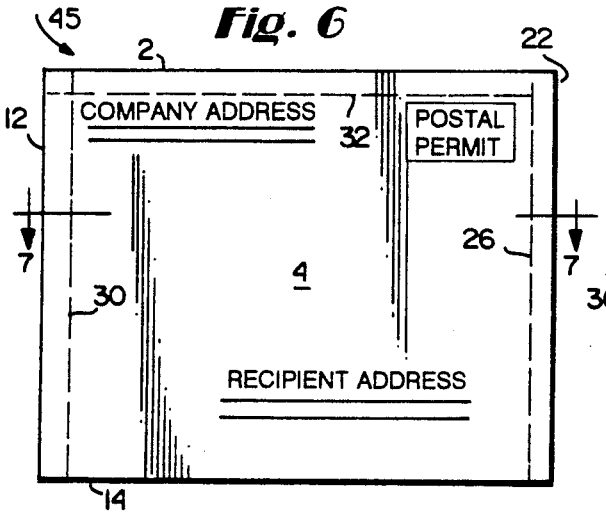
FIG. 6 is a view of the four ply mailer, with return envelope, according to the invention folded about a horizontal fold line as well as a vertical fold line, and ready for mailing.

By folding the two ply sheet illustrated in FIG. 5 along the registering portions of folding 14 such that panels 6 and 8 are folded backwardly, a mailer 45, as illustrated in FIG. 6, is provided. Note that the recipient's address on the face of panel 4 is exposed to view. Also, when this final folding occurs about fold line 14, the adhesive strips 36, 38 and 40 register with the margins of the panel 8. By passing the folded mailer through a heat sealer, the adhesive is activated, whereby the various panels are secured about each of the three marginal edges of the mailer to close the mailer. When the second fold about the line 14 is made, it is possible to insert between panels 8 and 10, one or more inserts. Thus, upon sealing the mailer, the insert is captured within the adhesive margins of the mailer and fold line 14.

The mailer, when received by the recipient, may be torn along the margin inset from the adhesive strips such that the mailer may be opened about fold line 14. The insert, if any, may then be removed and consequently, two sheets of the form are available and separated one from the other, i.e., the sheets containing panels 4 and 6 and the sheet containing panels 8 and 10. Detachment along fold line 14 (which preferably are formed by perforations, or score lines) also may be effected.

What has been described heretofore is basically a prior art mailer of FIGS. 8 through 12 of the U.S. Pat. No. 4,981,251. According to the invention, a return envelope is provided, which is seen most clearly with respect to FIGS. 1 through 3. As seen in FIG. 1, a seventh perforation 47 preferably is provided in the second panel 6, parallel to the first fold line 12, and spaced inwardly from the second perforation 26. Preferably three permanent adhesive strips 48–50 are provided on the second face of the second quadrant 6, as illustrated in FIG. 1, the strips 48, 49, parallel to, and adjacent, the second fold line 14 and the sixth perforation line 34, respectively. The adhesive strip 50 is parallel to an adjacent the fourth perforation line 30.

Figure 2:
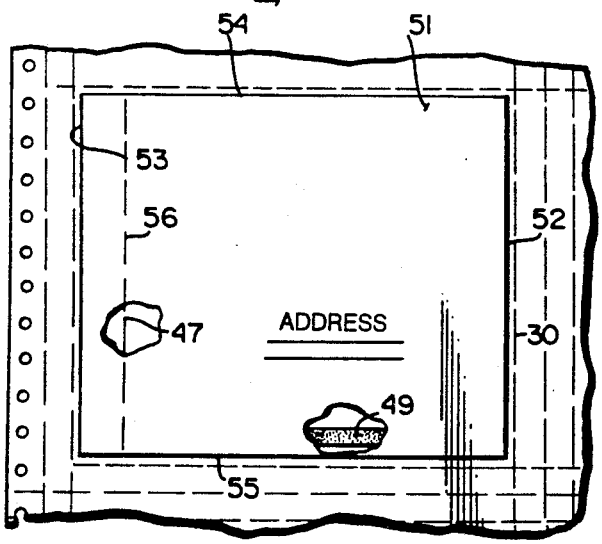
FIG. 2 is a view of the second quadrant of the intermediate of FIG. 1 showing the return envelope forming panel in place.

The return envelope is formed by the panel 51 engaging the adhesive strips 48-50. The panel 51 is illustrated most clearly in FIGS. 2 and 3 and comprises side edges 52, 53, and top and bottom edges 54, 55, respectively. A fold line 56 is provided adjacent but spaced from the edge 53, the fold line 56 preferably overlying the perforation 47 in the second quadrant 6 when the panel 51 is adhesively held in place (as illustrated in FIG. 2). Note that address information is provided on the face of the panel (FIG. 2) opposite the second quadrant 6. Disposed on the second face of the panel 51 (see FIG. 3) between the fold line 56 and the edge 53 is an adhesive strip 58. The adhesive strip 58 may comprise rewettable adhesive, but preferably is transfer tape.

Figure 7:
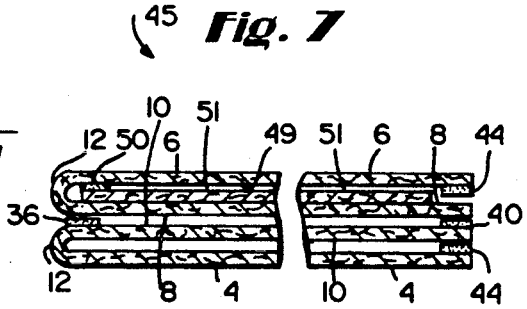
FIG. 7 is a cross-sectional view taken along lines 7—7 of FIG. 6, prior to the margins being heat sealed.

FIG. 7 illustrates the position of the return envelope formed by panel 51 in the final mailer 45 (but before heat sealing of the adhesive).

Figure 3:
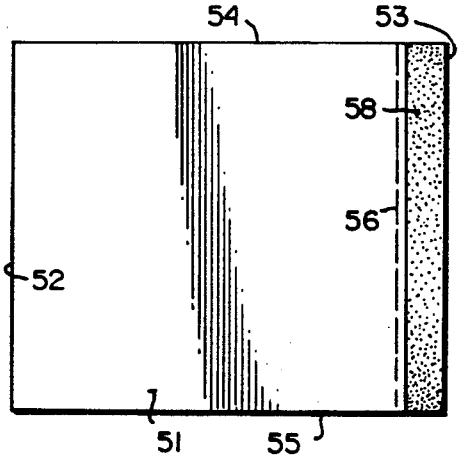
FIG. 3 is a top plan view of the opposite side of the return envelope forming panel that is seen in FIG. 2.

FIG. 8 schematically illustrates the method according to the invention for the production of a mailer type business form with return envelope. A sheet 1, preferably in the form of a continuous web (with like sheets on either side thereof), and having been preprinted with the address information and having vertical perforations already formed therein, is fed from a roll to a first reheatable glue applicator which applies glue patterns to the first face of the sheet 1 (e.g. strips 36, 38, and 40). The inverter unit 63 is then utilized to turn the web over so that it runs with the second face up through the balance of the operation. The second reheatable glue applicator 64 applies a glue pattern to the second face of the web 42 (44, 46). Glue pattern 48-49-50 is applied with unit 65 shown in FIG. 8. Associated with the machine 65 are a roll of transfer tape 66, a web 68 of panels 51, a feed tractor 67, and a slitter 69. Adjacent to the edge 53 illustrated in FIGS. 2 and 3 is a tractor drive portion. FIG. 8 shows the hole strip 70, containing the tractor drive openings, being separated by the slitter 69 from the panel 51.

After the panel 51 is properly positioned on sheet 1 of the web, as illustrated in FIG. 8, the web then passes to the conventional perforator unit 72 which provides all the horizontal perforations except for the folds. The fold perfs or scores (which have a different construction than the detachment perforations) are formed by the perforator 73. Then the web passes to the folder unit 74 which folds the sheet 1 about the fold line 12. After processing the form through a printing device to provide variable data entries, the mailer 45 so produced is then passed through conventional sealing apparatus. The mailer 45 according to the invention can be produced in one operation on a tight web Speedimailer® machine, such as a Speedifold® 85, the heat seal being provided by that machine.

More than one return envelope may be provided if desired, that is associated with the third and/or fourth quadrants. Also, while for convenience in the above description the return envelope has been described with respect to the second quadrant, it is to be understood that forming it with the third or fourth quadrants instead of the second quadrant, with similar accommodations for the third and fourth quadrants, is an equivalent for the purposes of interpretation of this specification and claims.

While the return envelope has been shown as a side opening envelope, it could have a top or bottom flap instead, or could be a double flap envelope. Also, windows or window patches can be added as necessary or desirable. In addition to the return envelope or envelopes, one or more additional inserts may be added by conventional equipment prior to folding of the sheet 1 about the orthogonal fold lines.

It will thus be seen that according to the present invention an easily manufactured mailer type business form, and intermediate therefor, and method of construction thereof, have been provided, which form may be made from a single sheet with an additional panel affixed thereto to provide a return envelope. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent products and procedures.

What is claimed is:

1. An intermediate of a mailer type business form comprising:

a quadrate ply having first and second faces;

first and second orthogonal fold lines separating said ply into first, second, third and fourth quadrants, said first and third quadrants diagonally dispose with respect to each other, said first and second quadrants separated by said second fold line, and said first and fourth quadrants separated by said first fold lines, and each of said quadrants of said quadrants having two free edges;

said first face of said first quadrant having outgoing addressee information thereon, and said first face of said fourth quadrant having adhesive strips adjacent said first fold line and two free edges thereof, but not adjacent said second fold line;

said second face of said first and second quadrants having adhesive strips adjacent said two free edges thereof, but not adjacent said fold lines;

a first perforation parallel to said first fold line and on the opposite side of said fourth quadrant adhesive strip adjacent a free edge from that free edge, and extending through said fourth and third quadrants;

a second perforation parallel to said first perforation and extending through said first and second quadrants spaced from the free edges thereof the same distance the first perforation is spaced from the free edges of said third and fourth quadrants;

third and fourth perforations parallel to said first perforation, and spaced an equal distance from, and adjacent, said first fold line, said third perforation extending through said third and fourth quadrants, and said fourth perforation through said first and second quadrants;

fifth and sixth perforations parallel to said second fold line, and adjacent but spaced from the free edges of quadrants parallel to said second fold line, said fifth perforation extending through said first and fourth quadrants, and said sixth perforation though said second and third quadrants;

a first panel, for cooperating with said second, third, or fourth quadrant for forming a return envelope, having dimensions less than the dimensions of said quadrant between an associated fold line and perforations; and adhesive means for attaching said first panel and said cooperating quadrant together to form a return envelope.

2. An intermediate as recited in claim 1 wherein said cooperating quadrant is said second quadrant, said first panel cooperating with said second quadrant second face and having dimensions less than the dimensions between said second fold line and said second, fourth and sixth perforations.

3. An intermediate as recited in claim 2 further comprising address information on said first panel, on a face thereof opposite said second quadrant.

4. An intermediate as recited in claim 3 further comprising an adhesive strip on said first panel adjacent said second perforation.

5. An intermediate as recited in claim 4 further comprising a fold line formed in said first panel on the opposite side of said adhesive strip from said second perforation, and wherein said adhesive strip comprises transfer tape.

6. An intermediate as recited in claim 4 wherein said adhesive means comprises strips of adhesive adjacent said second fold line, and said fourth and sixth perforations, but not said second perforation.

7. An intermediate as recited in claim 2 wherein said fifth and sixth perforations extend between, but not past, said first and second perforations.

8. An intermediate as recited in claim 1 wherein said ply and panel are of paper.

9. An intermediate as recited in claim 2 wherein said adhesive means comprises strips of adhesive adjacent said second fold line, and said fourth and sixth perforations, but not said second perforation.

10. An intermediate as recited in claim 9 further comprising an adhesive strip on said first panel adjacent said second perforation.

11. A mailer type business form comprising:

first, second, third, fourth, and fifth plies;

adhesive connecting said first ply to said fourth ply along two edges thereof;

adhesive connecting said fourth ply to said third ply along three edges thereof;

adhesive connecting said second ply to said third ply along two edges thereof;

adhesive connecting said fifth ply to another ply, and only that ply, spaced from the edges of that ply, to form a return envelope;

perforations along the side edges of said plies inside said adhesive, to provide removable edge strips of said plies so that said plies may be separated from each other by detachment of said edge strips to form four separate panels; and one of the panels formed by separation of said plies comprising said return envelope.

12. A mailer as recited in claim 11 wherein said fifth ply is connected to said second ply to form said return envelope, and said return envelope is disposed between said first and third plies.

13. A mailer as recited in claim 12 further comprising address information on said first ply outer face.

14. A mailer as recited in claim 13 further comprising address information on said fifth ply, on the face thereof opposite said second ply.

15. A mailer as recited in claim 12 wherein said return envelope has an open edge, an adhesive strip being provided on the face of said fifth ply closest to said second ply, at said open edge.

16. A mailer as recited in claim 15 wherein said fifth ply has a fold line adjacent said adhesive strip, and wherein said second ply has a perforation coincident with said fold line.

17. A mailer as recited in claim 16 wherein said adhesive strip is transfer tape, and wherein said plies are paper.

* * * * *